United States Patent [19]

Eaton et al.

[11] Patent Number: 4,759,957

[45] Date of Patent: Jul. 26, 1988

[54] POROUS METAL STRUCTURES MADE BY THERMAL SPRAYING FUGITIVE MATERIAL AND METAL

[75] Inventors: Harry E. Eaton, Woodstock; Richard C. Novak, Glastonbury, both of Conn.

[73] Assignee: United Technologies Corporation, Hartford, Conn.

[21] Appl. No.: 736,404

[22] Filed: May 20, 1985

Related U.S. Application Data

[63] Continuation-in-part of Ser. No. 565,541, Dec. 27, 1983, abandoned.

[51] Int. Cl.[4] ..... B05D 1/10

[52] U.S. Cl. ..... 427/226; 427/422; 427/423; 427/373

[58] Field of Search ..... 427/422, 34, 423, 373, 427/226

[56] References Cited

U.S. PATENT DOCUMENTS

| | | | |
|---|---|---|---|
| 2,718,473 | 9/1955 | Powers | 427/423 |
| 3,350,178 | 10/1967 | Miller | 75/222 |
| 3,540,884 | 11/1970 | Horbury | 75/211 |
| 3,723,165 | 3/1973 | Longo et al. | 427/423 |
| 4,025,669 | 5/1977 | Greenstein | 427/226 |
| 4,269,903 | 5/1981 | Clingman et al. | 428/591 |
| 4,336,276 | 6/1982 | Bill et al. | 427/423 |

*Primary Examiner*—Shrive P. Beck
*Attorney, Agent, or Firm*—C. G. Nessler

[57] ABSTRACT

Porous metal deposits especially useful in gas turbine engines as compressor seals are made by thermal spraying a metal powder and a meltable polymer powder mixture, wherein the spraying process and a subsequent polymer removal process are chosen to produce less than 30 weight percent oxide. Oxide contents of 4–25% are typical. When 86 weight percent nichrome is sprayed with 14 weight percent polymethylmethacrylate the polymer is removed by heating in air to about 315° C. The resultant porous structure will have an oxide content of 7% and an apparent density of about 32%. A meltable polymer additionally produces a more desirable pore structure.

10 Claims, 3 Drawing Sheets

100μm

100μm

100μm

100μm

POROUS METAL STRUCTURES MADE BY THERMAL SPRAYING FUGITIVE MATERIAL AND METAL

This application is a continuation of application Ser. No. 565,541, filed Dec. 27, 1983 and now abandoned.

TECHNICAL FIELD

The present invention relates to a method of making porous metal structures by thermal spraying, such as plasma arc spraying.

BACKGROUND

Porous metal structures may be made by a variety of processes and used in a variety of situations. It has been found that porous metal structures are particularly useful for abradable seals, which are structures that readily wear at a rapid rate when contacted by a high velocity part, but which otherwise have integrity. They are especially used in turbomachinery. See for instance U.S. Pat. Nos. 4,049,428 Elbert et al and 3,111,396 Ball.

One of the favored methods for making porous metal structures is to form a compact of metal and fugitive material, and then cause the fugitive material to disappear, thus leaving a metal structure with less than full density. Conventional powder metallurgy techniques which involve making an admixture, pressing and sintering, have been used. See U.S. Pat. Nos. 3,864,124 Breton et al, 3,897,221 Salyer et al and the Ball and Elbert et al patents. See also U.S. Pat. No. 3,350,178 to Miller.

Because of the substantial shrinkage which sintering causes in a powder metal article, we have previously preferred using plasma arc spraying to make porous metal structures. During plasma spraying of a metal-polymer mixture, the metal particulates are bonded to one another. Thus, a subsequent sintering is either not needed or, if used, does not cause excessive shrinkage. Generally, a composite has been first made according to the teachings of Longo et al in U.S. Pat. No. 3,723,165 wherein a metal powder such as nichrome is sprayed along with a high temperature polyester powder, such as poly(paraoxybenzoyl), having a high melting point. The polyester softens but does not melt during spraying. While the particular step of making a porous structure by subsequently oxidizing the polymer is not mentioned in the Longo et al patent, we and others have done so in the making of experimental porous seal structures for gas turbine engines. Since the polyester used is a high temperature material, temperatures in the range of 540° C. are needed to oxidize away the fugitive. However, while the abradable seals so made are effective for gas turbine engine use, the cost of the polyester resin particulate is high. Therefore, improvements have been sought, both to reduce costs and to improve the performance of abradable seals of porous metals by changing their physical and chemical characteristics.

Commonly owned U.S. patent application Ser. No. 406,404 filed Aug. 9, 1982 by Shiembob et al describes the use of a hard underlayer beneath a porous abradable material. Patent application Ser. No. 565,542 of Ottfinoski et al filed on even date herewith, also commonly owned, describes and claims porous metal seal structures having certain advantageous combinations of density and oxide content, best produced by means of the present invention.

DISCLOSURE OF THE INVENTION

An object of the invention is to provide an improved method for making porous metal structures, in particular for making an abradable seal for a turbine engine where the seal has improved performance and lower cost.

According to the invention, a polymer which is meltable and which has a low temperature of fleeing from a sprayed deposit is thermally sprayed together with a metal powder onto a substrate. The polymer is made to flee from the deposit by heating to a temperature less than that which causes more than 30 weight percent oxide to be present in the porous metal deposit which remains. It has been discovered that a low oxide content in an abradable seal material enhances its performance, particularly with respect to avoiding glazing during interaction with a compressor blade.

Preferably, plasma arc spraying, or another spraying process which avoids excess oxidation of the particulate, is used to make an initial deposit of polymer and metal mixture on a substrate. Then the polymer is removed by heating to a relatively low temperature. The polymer may disappear by depolymerizing to a volatile, chemically combining to form a volatile, by dissolution, or by another process which does not involve excess heat generation. Depolymerization is preferred because it is an endothermic process and thus contrasts favorably with an oxidation process which exothermically can raise temperatures and cause unwanted oxidation or other reaction. The invention applied to nichrome alloys produces oxide contents of 4–30 weight percent in structures which are 26–40% of the density of solid metal. Such levels compare with a typical 30–40 weight percent oxide content characteristic of nichrome porous metals made by the earlier technique using a high temperature polymer. Preferably, the polymer and metal deposit is heated in air to reduce cost. For nichrome alloys this essentially means conducting the removal process at a low temperature, less than 540° C., preferably 250°–430° C.

In a preferred practice of the invention, 14 weight percent polymethylmethacrylate powder is sprayed with 86 weight percent 80 Ni-20 Cr powder. The deposit so created is heated to about 315° C. to convert the polymer to a volatile monomer. The resultant porous metal structure has an apparent specific gravity of 2.7 g/cc, or about 32% of theoretical for the metal.

By using plastics which are meltable, compared to those which only heat soften during spraying, an improved character of pore structure results. This pore structure is associated with better performance in abradable seals, as is the lower oxide content.

The foregoing and other objects, features and advantages of the present invention will become more apparent from the following description of preferred embodiments and accompanying drawings.

BEST MODE FOR CARRYING OUT THE INVENTION

The invention is described in terms of the manufacture of an abradable seal structure of a nickel chrome alloy, 80 Ni-20 Cr. The spraying of a mixture of metal and polymer is described in U.S. Pat. Nos. 3,179,784 to Johnson and 3,723,165 to Longo et al, the disclosures of which are hereby incorporated by reference. In the preferred practice of the present invention a polymer powder is used which has a depolymerization temperature of less than 430° C. Preferably, the powder is a polymethylmethacrylate, such as Lucite Grade 4FNC-99 powder (Dupont Company). A powder mixture by weight of 14% Lucite and 86% nichrome is sprayed. The nichrome is nominally −250+500 Tyler Sieve Series mesh size (hereinafter called "−250 nichrome") while the Lucite is −80+400 mesh. About 0.2 weight percent of submicron silica particulate, such as Cab-o-Sil powder (Cabot Corporation), is added as needed to improve flow properties of the mixture. The mixture is passed through a plasma arc torch and is deposited to a thickness of about 2 mm on a suitably prepared substrate such as a nickel superalloy workpiece, using practices commonly known for plasma arc spraying.

Figure 1:
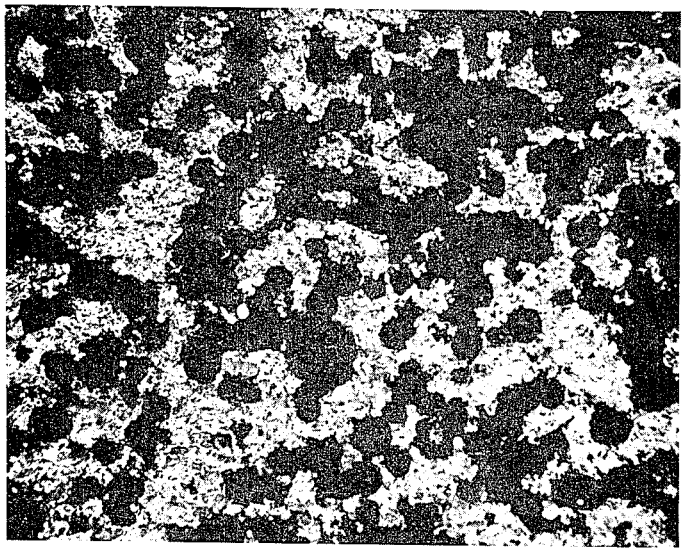
FIG. 1 is a photomicrograph showing the cross section of a porous nichrome metal structure made with polymethylmethacrylate in accord with the invention.

After the desired thickness of sprayed deposit has been accumulated, it is heated in air, vacuum, or inert atmosphere. Preferably, air is used for simplicity. The article is heated to a temperature of about 315° C. for about 2 hr to cause the polymer to depolymerize and to form the monomer which volatilizes from the article, thereby leaving on the substrate a porous metal structure. FIG. 1 is a photomicrograph of the cross section of the resultant nichrome metal layer which has an apparent density of 2.7 g/cc, about 32% of theoretical nichrome metal density. (The structures of FIG. 1 and FIG. 2 appear essentially the same as shown here when viewed perpendicular to the cross section.) Density is measured in the conventional manner by dividing the weight of a specimen by the volume its exterior surface encompasses. But the nichrome porous structure described above is comprised of metal and about 25% metal oxide. The Ni-Cr oxides, which have not been accurately characterized, are lower in specific gravity than the metal. Thus the actual porosity of a structure made in the invention is less than the ratio of structure specific gravity to fully dense metal specific gravity indicates; e.g., the 2.7 g/cc porous structure of 8.4 g/cc nichrome, having an apparent 32% density, is somewhat less than 68% void.

To appreciate the invention's advantage, it must be understood that the desired function of an abradable material is that it remain intact under particulate erosion and other mechanical stresses. Yet it must easily disintegrate in a friable mode when it is contacted by a high speed moving part, such as a blade tip. This characteristic is called abradability. In the absence of such easy disintegration behavior, the tip of the blade will be excessively heated and degraded itself. In performance tests simulating operation in a gas turbine engine, the structure produced using the polymethylmethacrylate resin has been found surprisingly different and superior to those produced with the polyester resin. Most notably the new abradable material has less tendency to smear or glaze over when contacted with the blade tip, compared to the same structure made with a polyester resin. Glazing is symptomatic of inadequate abradability. We have discovered some of the phenomena which underlie this improved performance and which are peculiar to the utilization of meltable low temperature polymer powders such as polymethylmethacrylate.

Figure 3:
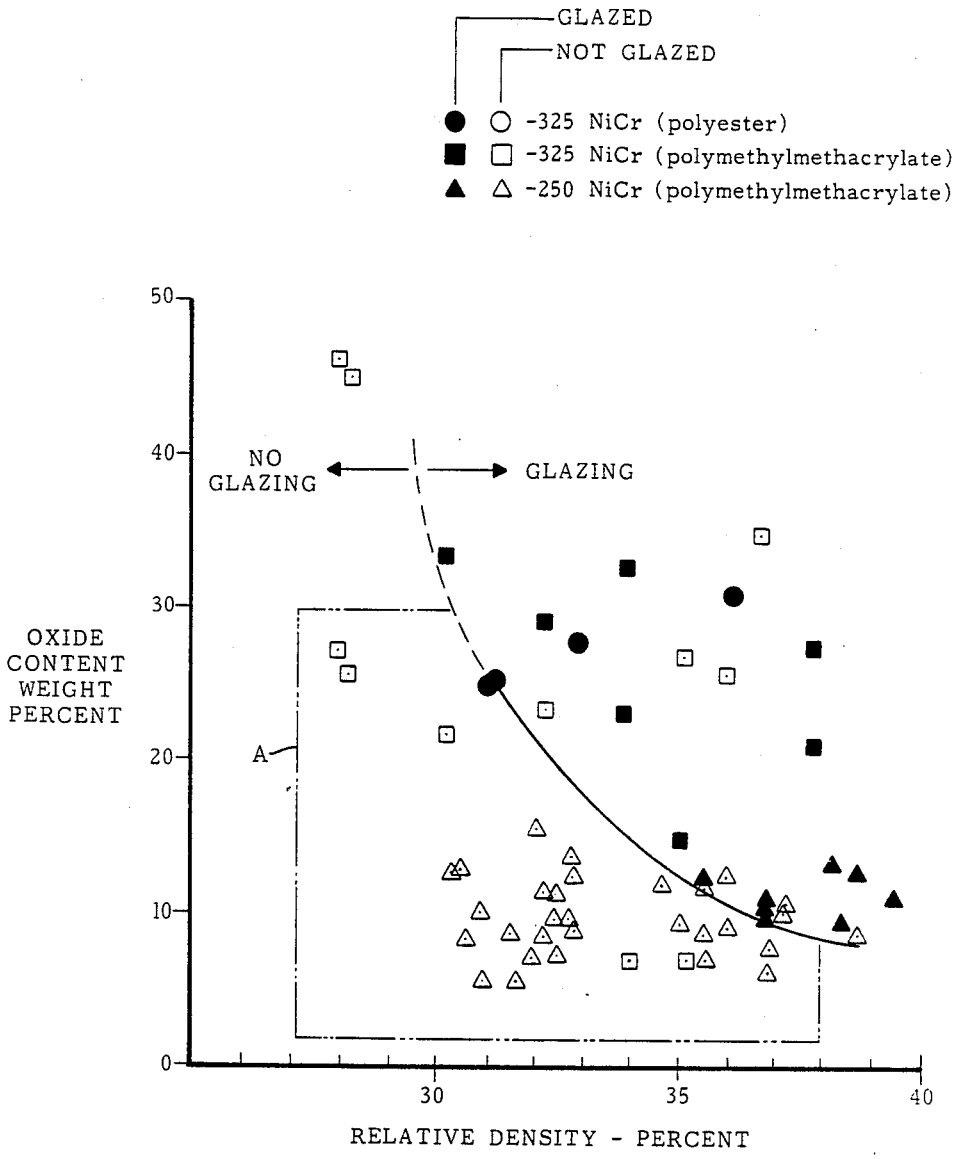
FIG. 3 is a graph showing how oxide content influences the glazing character of a 80-20 nichrome structure, where the absence of glazing is good.
Figure 4:
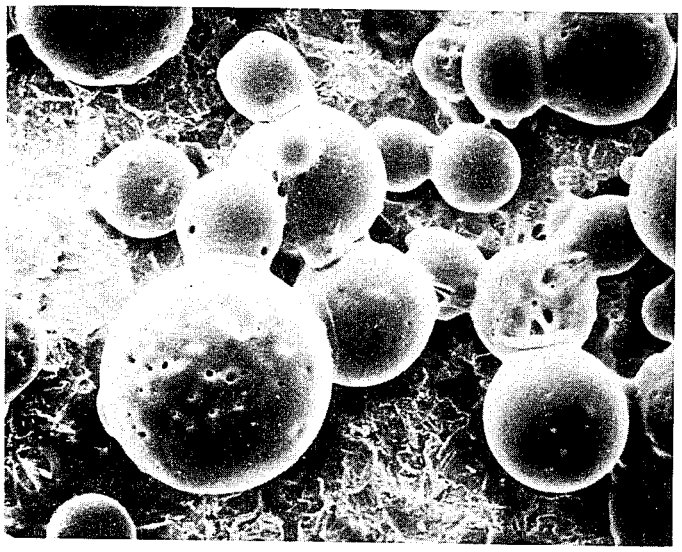
FIG. 4 is a photograph showing the shape of polymethylmethacrylate (Lucite) particulate after thermal spraying into free air.

First, the oxide content of the improved abradable seals has been found to be about 25 weight percent when using the −250 nichrome, compared to the same seal made using the polyester resin, wherein an oxide content of about 35 weight percent results. Whereas related experience would seem to suggest that higher oxide contents would be desirable in that they generally are associated with embrittling of metals, we have discovered that seals with lower oxide content produce improved performance. FIG. 3 illustrates how glazing is dependent on oxide content over a particular useful range of density of nichrome. The data are based on visual observation of the rubbed surface of a porous metal structure which was contacted at a temperature of about 24° C. by six simulated AMS 4928 titanium alloy blade tips at rubbing speeds of about 290 m/s. Glazing is evident if the rubbed surface of the sprayed structure is shiny and metallic, as opposed to dull, after the rubbing test. In addition, glazing is evidenced by significant wear of the rubbing blade, compared to a no-glazing condition where the aggregate volume of titanium lost from a blade will be less than 0.5–2% of the aggregate volume of material removed from the seal structure during a rub test. Oxide content of a seal structure is calcuable using conventional digestion techniques. For nichrome, we use hot methanol-5% bromine and chacterize the insoluble residue as oxide.

In the process of removing a prior art polyester resin from a sprayed deposit, owing to the high temperature characteristics of the resin, furnaces set at about 540° C. must be used. Oxidation of the polymer during such removal has been found to exothermically further raise the temperature of the porous metal structure to about 620° C. Owing to the high surface area of a porous metal structure, the indicated relatively high degree of oxidation results, even through nichrome is an oxidation resistant alloy. Thus, the polymer removal process is revealed to be critical and the use of a fugitive material which depolymerizes or otherwise flees at a low temperature is necesitated. The oxide is generally dispersed through the metal of the structure and is not as might be expected concentrated on the surfaces surrounding the visible pores. Table 1 shows the oxide content of 2.7 g/cc 80-20 NiCr porous material resulting from 100 hr exposure to certain baking temperatures which may be used to drive off various fugitive material. The data show an unexpected oxidation resistance superiority of a deposit made with polymethylmethacrylate (Lucite), compared to the same deposit made with polyester (Ekonol). This may be due to the more favorable pore structure which the meltable polymer provides. Our method enables achievement of a desired oxide content of less than 35%, usually in the 20–30% range. With metals having oxidation characteristics similar to 80–20 nichrome, this necessitates generally that the polymer decompose or convert to a volatile constituent such as a monomer or gas at a temperature of less than about 540°

C. With less oxidation resistant metals lower temperatures will be required.

Second, the physical structure of porous metal produced by the use of a meltable low temperature polymer is improved insofar as abradability over that produced with a higher temperature heat softening polymer. This can be appreciated by comparing

TABLE 1

Approximate Oxygen Content of Abradable Material Spray Deposit as it is Affected by 100 hr Thermal Exposure

| Polymer/Metal Sprayed | Exposure Temperature (°C.) | Oxide Content (Wt. %) Initial | Final |
|---|---|---|---|
| Lucite/−250 mesh 80Ni20Cr | 540 | 7 | 11 |
| Lucite/−325 80Ni20Cr | 540 | 21 | 36 |
| Ekonol/−250 80Ni20Cr | 540 | 27 | 43 |
| Ekonol/−325 80Ni20Cr | 540 | — | 43 |
| Lucite/−325 80Ni20Cr | 650 | 22 | 47 |
| Ekonol/−325 80Ni20Cr | 650 | 32 | 58 |
| Lucite/−325 CoCrAlY* | 540 | 15 | 22 |
| Lucite/−325 NiCrAlY* | 540 | 7 | 10 |

*See U.S. Pat. Nos. 3,676,085, 3,754,903 and 3,542,530

Figure 2:
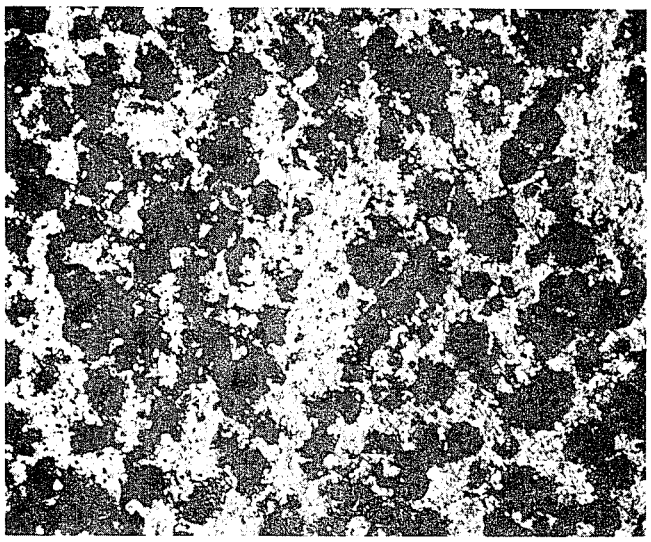
FIG. 2 is similar to FIG. 1 but shows a nichrome structure made with polyester according to the prior art, having a different character of porosity from FIG. 1.

FIG. 1 with FIG. 2 which is a photograph of a cross section made by spraying a mixture by weight percent 75 NiCr and 25 Ekonol polyparaoxybenzoyl polyester resin (Carborundum Co. and Metco Inc.) of −150+325 mesh. The specimen shown in FIG. 2 has a density of 2.8 g/cc, essentially the same as that of the FIG. 1 specimen. (A lower deposit efficiency necessitates using more volume percent Ekonol than Lucite to obtain the same porosity.) Yet, it is seen that the structure in FIG. 1 has more openness to it. We attribute this to the behavior of the Lucite particulate since it is melted and apparently agglomerates during its transit to the substrate, whereas the Ekonol does not. The melting type of polymer produces a wider range of pore sizes, and the greater amount of large pores creates the more open appearance in the structure.

Figure 5:
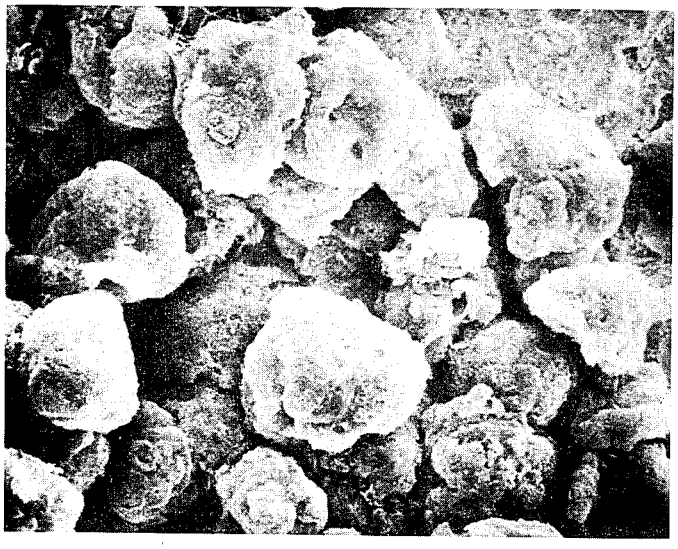
FIG. 5 is similar to FIG. 4 showing polyparaoxybenzoyl (Ekonol) particulate.

FIGS. 5 and 6 show the difference in behavior between the Lucite and Ekonol resins when they are plasma arc sprayed by themselves into free air and collected. The Ekonol material in FIG. 5 exhibits no sign of melting and remains as individual particulate, whereas the Lucite has melted into spheres and agglomerated.

Generally, the invention involves the use of a polymer which melts and which volatilizes at a temperature less than that which causes more than 30% oxide in the metal. For nichrome, various polymers will be suitable, including those selected from the general group comprised of polystrenes, polyethylenes, polypropylenes and polyacrylates, all fleeing the substrate at atmospheric pressure under temperatures of less than 540° C. For example, polymethylmethacrylate decomposes at about 250° C. and we heat it to about 315° C. for convenience and speed. A further reason to prefer the last mentioned material is because of its ready availability as a particulate at a low cost.

Of course, the primary cause of oxidation of the porous structure which our procedure addresses involves the step for removing the fugitive polymer. But care must be taken to prevent oxidation during the thermal spraying process as well. For nichrome-polymer, plasma arc spraying in air with 50—50 argon-helium at an enthalpy of about 7 kwhr/m$^3$ produces good results. Plasma arc spraying in air in general will be useful since it involves the use of non-oxidizing gases. But other thermal spraying processes such as combustion spraying and detonation gun processes can be useful as well, where they are known to produce deposits with relatively low oxide contents, of less than about 25%. And of course, the oxide content of a deposit will vary according to the metal powder size which is used with coarser powders producing less oxide content. With −250 nichrome the oxide contents will be in the 4–10% range after the polymer is removed. Not only does the as-sprayed deposit of a coarser metal powder have less oxide, but we have discovered the rate of oxidation at a constant temperature in the 200°–650° C. range is less, apparently due to a difference in the character of the sprayed structure. See again Table 1 where −325 mesh+500 mesh powder ("−325 mesh 80 Ni 20 Cr") produces high oxygen content compared to −240 mesh 80 Ni 20 Cr.

When an abradable seal is made for use at elevated temperatures, the spray deposit will be applied onto a curved piece of nickel or iron superalloy, e.g., IN 718 or AISI 410 alloys. After the fugitive material is removed the metal porous structure will be well bonded to the superalloy substrate, by which means it is affixed in the engine. To make such structures of nichrome we spray from 80 to 90 weight percent nichrome with 20 to 10 percent polymethylmethacrylate. These mixtures produce deposits of from 35 to 45 volume percent polymer, preferably 37–43 percent. The resultant metal deposits, after the polymer is caused to flee have void contents of 50–70 volume percent, i.e., the apparent density is 30–50 percent.

As a specific example, the nichrome specimen mentioned above, created by spraying 86 nichrome with 14 polymethylmethacrylate, has a density of about 2.7 gm/cc and an oxide content of 7%. Weight loss measurement during removal of the fugitive polymer shows the deposit was 43 volume percent polymer. The apparent density is 32%, so without the small adjustment for the volume of metal oxide (compared to pure metal alloy), the apparent void content is 68%. Thus, the void content of a finished deposit is greater than that provided by the polymer. It is well known plasma coatings are porous as sprayed and this inherent void creation and other phenomena associated with the process described are apparently operable in providing the finished product.

To obtain comparable results with other polymers mentioned above, due adjustment in deposit composition must be made to account for change in density to obtain the desired porosity. And further adjustment in the composition of the mixture sprayed would be made to account for the efficiency of deposition of the polymer and metal constituents.

The invention is especially meaningful for porous abradale seal structures made of nichrome alloys generally, as they are commonly known in diverse compositions, since such materials have exhibited good performance heretofore in seals made by older techniques. Nonetheless, the invention will be applicable to other materials as well, including other alloys of nickel, and alloys based on iron, cobalt and aluminum.

Although this invention has been shown and described with respect to a preferred embodiment, it will be understood by those skilled in the art that various changes in form and detail thereof may be made without departing from the spirit and scope of the claimed invention.

We claim:

1. The method of making a porous metal structure which comprises thermal spraying a mixture of metal powder and polymer powder onto a substrate to first form a sprayed deposit and then heating the deposit to cause the polymer to flee from the deposit, characterized by using a polymer powder which becomes molten and spherical in shape during spraying and which by virtue of its melted shape thereby produces in the metal structure a desirable pore shape; and, endothermically decomposing the polymer by heating the sprayed deposit to a temperature of less than 540° C., to produce less than 30 weight percent oxide content in the remaining deposit.

2. The method of claim 1 wherein the heating takes place in an oxidizing environment.

3. The method of claim 1 wherein the polymer is selected from the group consisting of polystrenes, polyethylenes, polypropylenes and polyacrylates.

4. The method of claim 3 wherein the polymer is polymethylmethacrylate.

5. The method of claim 3 wherein the Tyler Sieve Series Mesh size of the metal powder is between 250 and 500 mesh and the size of the polymer powder is between 80 and 400 mesh.

6. The method of claim 1 wherein the porous metal structure is deposited on a metal substrate in the shape of a seal for a gas turbine engine and wherein the porous metal structure does not glaze when rubbed by a titanium alloy blade moving at about 290 m/s.

7. The method of claim 1, wherein the heating is to a temperature of 250°–430° C.

8. The method of claim 1, wherein the sprayed deposit is comprised of about 35 to 45 volume percent polymer.

9. The method of claim 1, wherein the volume percent polymer is 37–43.

10. The method of making a porous metal structure for use as a seal in a gas turbine engine which comprises thermal spraying a mixture of nickel alloy metal powder and polymer powder onto a substrate to first form a sprayed deposit and then heating the deposit to cause the polymer to flee from the deposit, characterized by spraying polyacrylate polymer powder as spherical molten droplets together with the metal to form a sprayed deposit comprised of 35–45 volume percent polymer; and endothermically decomposing the polymer by heating the sprayed deposit to a temperature of less than 540° C. in air, to thereby produce a porous metal structure having a desirable pore shape and less than 30 weight percent oxide.

* * * * *